US009126602B2

(12) United States Patent
Bigras et al.

(10) Patent No.: US 9,126,602 B2
(45) Date of Patent: Sep. 8, 2015

(54) ROOF STRUCTURE FOR A VEHICLE

(71) Applicant: Bombardier Transportation GmbH, Berlin (DE)

(72) Inventors: Martin Bigras, Longueuil (CA); Ross Patrick Myher, Toronto (CA); Timothy Raymond Smith, Commerce Township, MI (US); Sam Rostami, Toronto (CA)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 14/228,344

(22) Filed: Mar. 28, 2014

(65) Prior Publication Data

US 2014/0298733 A1 Oct. 9, 2014

Related U.S. Application Data

(60) Provisional application No. 61/809,944, filed on Apr. 9, 2013.

(51) Int. Cl.
*B61D 17/00* (2006.01)
*B61D 17/12* (2006.01)

(52) U.S. Cl.
CPC ..... *B61D 17/00* (2013.01); *B61D 17/12* (2013.01)

(58) Field of Classification Search
CPC ..... B61D 17/00; B61D 17/12; B62D 25/06; E04D 3/30
USPC ..... 52/48, 45, 56, 53, 17, 657; 296/178, 296/179, 210; 105/396, 397, 399, 401; 244/119
See application file for complete search history.

(56) References Cited

U.S. PATENT DOCUMENTS

| | | | | | |
|---|---|---|---|---|---|
| 591,665 | A | * | 10/1897 | Eubank | 52/47 |
| 1,004,044 | A | * | 9/1911 | Lavis | 52/48 |
| 1,697,386 | A | * | 1/1929 | Douglas et al. | 296/178 |
| 1,943,472 | A | * | 1/1934 | Frazer | 296/178 |
| 2,004,199 | A | * | 6/1935 | Gallagher | 105/410 |
| 2,190,227 | A | * | 2/1940 | Best | 296/203.01 |
| 2,556,062 | A | * | 6/1951 | Buehrig | 296/218 |
| 3,408,779 | A | * | 11/1968 | Allen et al. | 52/53 |

(Continued)

FOREIGN PATENT DOCUMENTS

| | | | |
|---|---|---|---|
| DE | 102007022198 | A1 | 11/2008 |
| DE | 102011004529 | A1 | 8/2012 |

(Continued)

*Primary Examiner* — Brent W Herring
(74) *Attorney, Agent, or Firm* — The Webb Law Firm

(57) ABSTRACT

There is provided a roof for a vehicle where each one of its right and left side wall has at least a first and a second door opening. The roof structure comprises a lattice structure and an outer shell. The lattice structure has two pairs of longitudinal segments adapted to be located at a top portion of the first and second door openings and two diagonal segments. One diagonal segment extends from a first longitudinal segment adapted to be located at the first door opening in the right wall to a second longitudinal segment adapted to be located at the second door opening in the opposite wall. The other diagonal segment extends from a first longitudinal segment adapted to be located at the first door opening in the left wall to a second longitudinal segment adapted to be located at the second door opening in the opposite wall. The outer shell is placed atop the lattice structure and extends from a region proximate the front end to a region proximate the rear end of the vehicle.

13 Claims, 6 Drawing Sheets

(56) References Cited

U.S. PATENT DOCUMENTS

| | | | | | |
|---|---|---|---|---|---|
| 3,427,068 | A | * | 2/1969 | Keahn et al. | 296/210 |
| 3,434,256 | A | * | 3/1969 | Eggert, Jr. | 52/204.1 |
| 3,820,476 | A | * | 6/1974 | Harter et al. | 105/404 |
| 4,014,585 | A | * | 3/1977 | Earnhart | 296/16 |
| 4,045,075 | A | * | 8/1977 | Pulver | 296/205 |
| 4,358,914 | A | * | 11/1982 | Geyer | 52/643 |
| 5,042,395 | A | * | 8/1991 | Wackerle et al. | 105/397 |
| 6,164,210 | A | * | 12/2000 | Coslovi et al. | 105/396 |
| 6,205,932 | B1 | | 3/2001 | Khattab | |
| 6,666,499 | B2 | * | 12/2003 | Stewart et al. | 296/203.01 |
| 6,921,130 | B2 | * | 7/2005 | Barz et al. | 296/203.02 |
| 7,556,116 | B2 | * | 7/2009 | Ootani et al. | 180/274 |
| 7,648,190 | B2 | * | 1/2010 | Timmermans et al. | 296/178 |

FOREIGN PATENT DOCUMENTS

| | | |
|---|---|---|
| GB | 361425 | 11/1931 |
| WO | 2011038755 A1 | 4/2011 |

* cited by examiner

ROOF STRUCTURE FOR A VEHICLE

CROSS REFERENCE TO RELATED APPLICATION

This application claims the benefit of U.S. Provisional Application No. 61/809,944, filed Apr. 9, 2013, entitled "Roof Structure For A Vehicle", which is incorporated herein by reference.

BACKGROUND OF THE INVENTION

1. Field of the Invention

The subject matter disclosed generally relates to vehicle structures. More particularly, the subject matter relates to a roof structure for a vehicle made of a lattice structure adapted to join top portions of door openings and of an outer shell.

2. Description of Related Art

Whether it is a rail vehicle, an aircraft or a bus, the structures of long mass transit vehicle are often designed in a similar fashion: ribs are placed along the length of the vehicle and are wrapped with an exterior skin. For ease of construction, the vehicle structure is typically made of a floor, two side walls and a roof and two end caps.

The roof structures of such vehicles are typically made of either parallel ribs covered by the exterior skin or covered by open extrusions, longitudinally extending closed extrusions or a sandwich structure. However, none of these structures is optimized for stress loads on the vehicle and are therefore heavier than necessary.

There is therefore a need for an improved roof structure for a vehicle.

SUMMARY OF THE INVENTION

In accordance with a first embodiment, there is provided a roof for a vehicle where the vehicle has a front end and a rear end, a left and a right side walls and wherein each one of the right and left side wall has at least a first and a second door opening. The roof structure comprises a lattice structure and an outer shell. The lattice structure has a pair of first longitudinal segments, a pair of second longitudinal segments, a first diagonal segment and a second diagonal segment. The pair of first longitudinal segments has a right first longitudinal segment and a left first longitudinal segment. The right first longitudinal segment is adapted to run along a top portion of the first door opening in the right side wall while the left first longitudinal segment is adapted to run along a top portion of the first door opening in the left side wall. The pair of second longitudinal segments has a right second longitudinal segment and a left second longitudinal segment. The right second longitudinal segment is adapted to run along a top portion of the second door opening in the right side wall while the left second longitudinal segment is adapted to run along a top portion of the second door opening in the left side wall. The first diagonal segment extends from the right first longitudinal segment to the left second longitudinal segment. The second diagonal segment extends from the left first longitudinal segment to the right second longitudinal segment. The outer shell is placed atop the lattice structure and extends from a region proximate the front end to a region proximate the rear end of the vehicle.

Optionally, the roof further comprises a first transversal segment and a second transversal segment. The first transversal segment extends between the right first longitudinal segment and the left first longitudinal segment. The second transversal segment extends between the right second longitudinal segment and the left second longitudinal segment.

Optionally, the pair of first longitudinal segments extends up to the pair of second longitudinal segments.

According to another embodiment, the pair of first longitudinal segments is located proximate the front end of the vehicle and extends up to the front end while the pair of second longitudinal segments is located proximate the rear end of the vehicle and extends up to the rear end. In this case, the pair of first longitudinal segments and the pair of second longitudinal segments may form a pair of continuous longitudinal segments.

Optionally, the outer shell is made of a sandwich construction.

The pair of first longitudinal segments, the pair of second longitudinal segments, the first diagonal segment and the second diagonal segment may be made of composite materials.

According to another embodiment, there is provided roof for a vehicle where each one of the left and right side walls are further equipped with a third door opening. In this case the lattice structure further comprises a pair of third longitudinal segments, a third diagonal segment and a fourth diagonal segment. The pair of third longitudinal segments has a right third longitudinal segment and a left third longitudinal segment. The right third longitudinal segment is adapted to run along a top portion of the third door opening in the right side wall while the left third longitudinal segment is adapted to run along a top portion of the third door opening in the left side wall. The third diagonal segment extends from the right second longitudinal segment to the left third longitudinal segment. The fourth diagonal segment extends from the left second longitudinal segment to the right third longitudinal segment.

Optionally, the roof further comprises a longitudinal median segment. The longitudinal median segment extends from an intersection point between the first and the second diagonal segments to an intersection point between the third and the fourth diagonal segments.

According to another embodiment, the roof further comprises a first transversal segment and a second transversal segment. The first transversal segment extends between the right first longitudinal segment and the left first longitudinal segment. The second transversal segment extends between the right third longitudinal segment and the left third longitudinal segment.

Optionally, the pair of first longitudinal segments extends up to the pair of second longitudinal segments while the pair of second longitudinal segments extends up to the pair of third longitudinal segments.

Optionally, the pair of first longitudinal segments is located proximate the front end of the vehicle and extends up to the front end and the pair of third longitudinal segments is located proximate the rear end of the vehicle and extends up to the rear end.

According to another embodiment, the pair of first longitudinal segments, the pair of second longitudinal segments and the pair of third longitudinal segments form a pair of continuous longitudinal segments.

Optionally, the outer shell is made of a sandwich construction.

According to another embodiment, the pair of first longitudinal segments, the pair of second longitudinal segments, the pair of third longitudinal segments, the first diagonal segment and the second diagonal segment are made of composite materials.

According to yet another embodiment, there is provided a roof for a vehicle where each one of the left and right side walls are further equipped with a fourth door opening. In this case, the lattice structure comprises a pair of fourth longitudinal segments, a fifth diagonal segment and a sixth diagonal segment. The pair of fourth longitudinal segments has a right fourth longitudinal segment and a left fourth longitudinal segment. The right fourth longitudinal segment is adapted to run along a top portion of the fourth door opening in the right side wall while the left fourth longitudinal segment is adapted to run along a top portion of the fourth door opening in the left side wall. The fifth diagonal segment extends from the right third longitudinal segment to the left fourth longitudinal segment. The sixth diagonal segment extends from the left third longitudinal segment to the right fourth longitudinal segment.

Optionally, the lattice structure further comprises a longitudinal median segment extending from an intersection point between the first and the second diagonal segments to an intersection point between the fifth and the sixth diagonal segments.

According to another embodiment, the roof further comprises a first transversal segment and a second transversal segment. The first transversal segment extends between the right first longitudinal segment and the left first longitudinal segment. The second transversal segment extends between the right fourth longitudinal segment and the left fourth longitudinal segment.

Optionally, the pair of first longitudinal segments extends up to the pair of second longitudinal segments, the pair of second longitudinal segments extends up to the pair of third longitudinal segments and the pair of third longitudinal segments extends up to the pair of fourth longitudinal segments.

According to another embodiment, the pair of first longitudinal segments is located proximate the front end of the vehicle and extends up to the front end while the pair of fourth longitudinal segments is located proximate the rear end of the vehicle and extends up to the rear end.

According to another embodiment, the pair of first longitudinal segments, the pair of second longitudinal segments, the pair of third longitudinal segments and the pair of fourth longitudinal segments form a pair of continuous longitudinal segments.

Optionally, the first pair of longitudinal segments, the second pair of longitudinal segments, the third pair of longitudinal segments, the fourth pair of longitudinal segments, the first diagonal segment and the second diagonal segment are made of composite materials.

According to yet another embodiment, there is provided a vehicle having a front end and a rear end where the vehicle comprises a floor, a left side wall, a right side wall where each one of the right and left side walls have at least a first and a second door opening and where the roof is made according to any one of the preceding embodiments.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

DESCRIPTION OF THE INVENTION

The roof structure described herebelow is made of a lattice structure covered by an outer shell or sandwich construction. The lattice structure is oriented with the main load paths so as to decrease the weight of the structure as much as possible. Mass transit vehicles, such as a rail vehicle, are generally equipped with at least 4 doors placed in both side walls. Often, such vehicles may be equipped with 6 or even 8 doors placed either symmetrically or staggered. The present invention will be described with respect to a rail vehicle having six door openings placed symmetrically in each of its lateral walls. However, it will be understood that the present invention may also be used with varying number of doors and with doors that are not necessarily placed symmetrically in each side walls.

Figure 1:
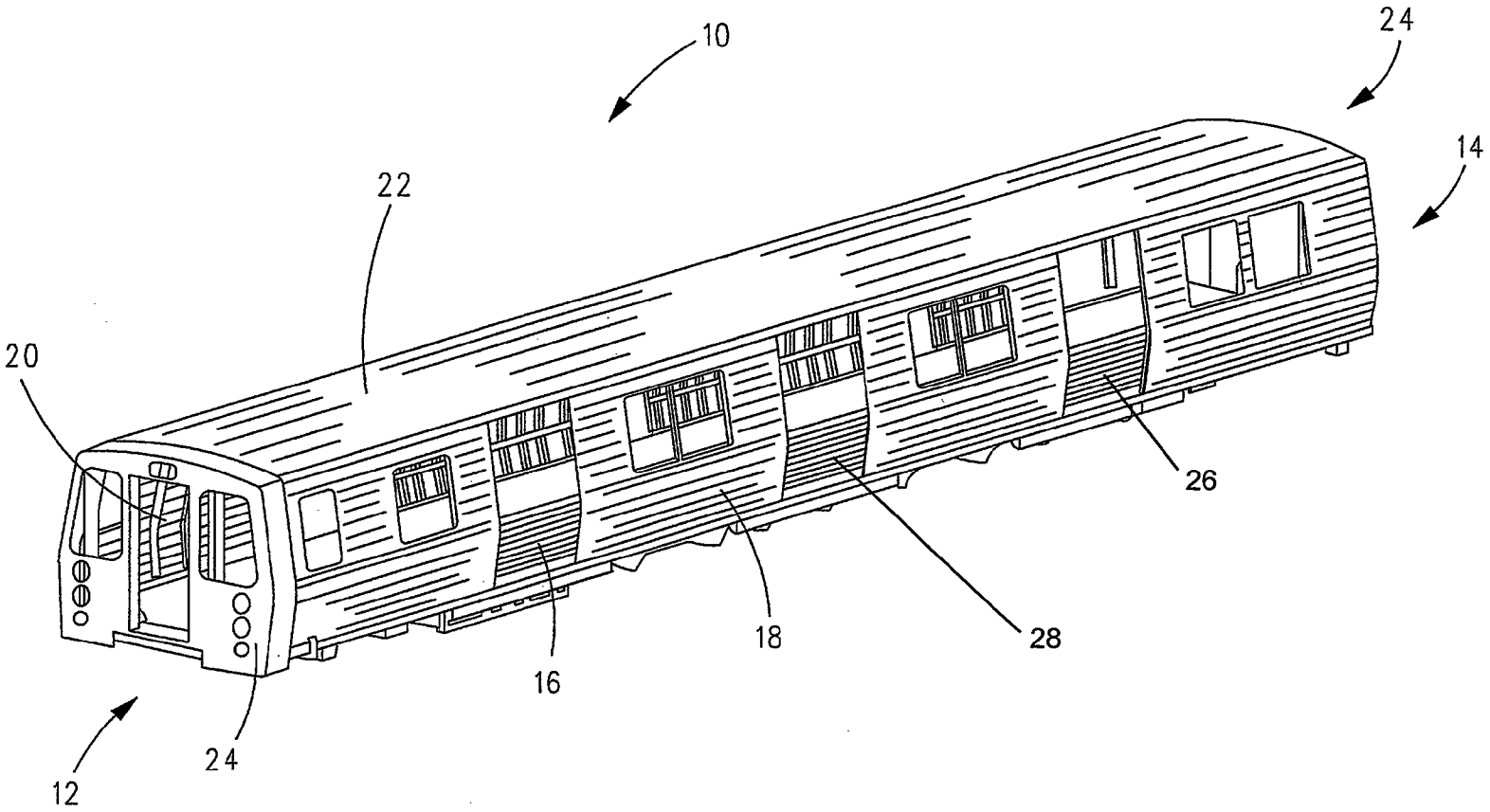
FIG. 1 is a perspective view of a rail vehicle body in accordance with an embodiment of the present invention.

FIG. 1 is now referred to. A vehicle body 10 has a front end 12 and a rear end 14 and is made of a floor 16, a left side wall 18, a right side wall 20, a roof 22 and end caps 24. Each one of the right and left side walls 20, 18 have at least a first door opening 26 and a second door opening 28.

Figure 2:
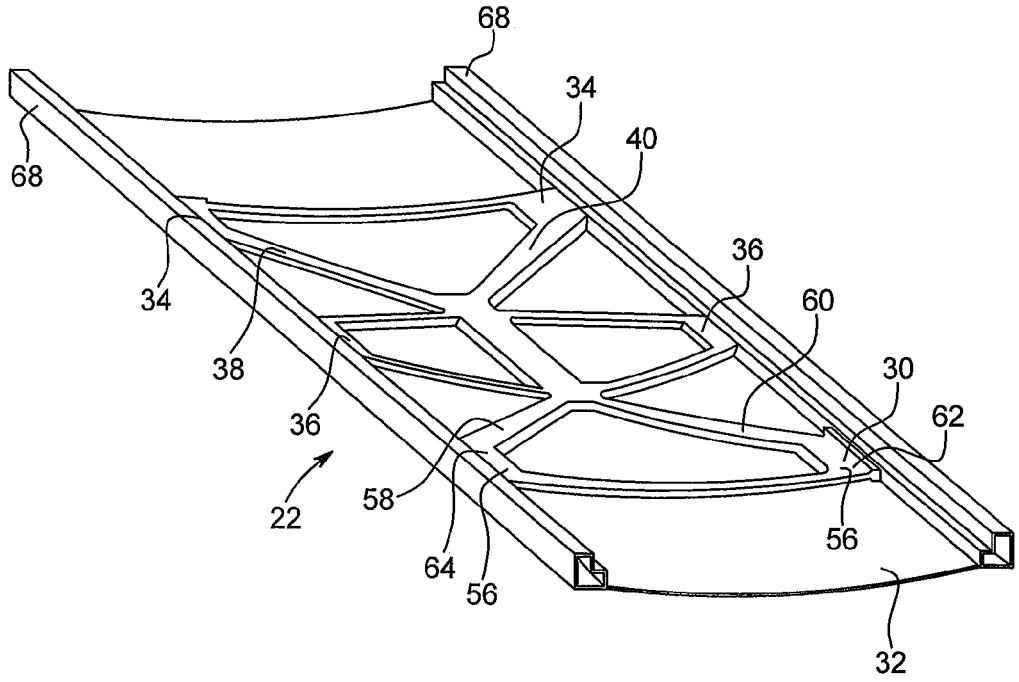
FIG. 2 is a perspective bottom view of a roof of the vehicle body of FIG. 1.
Figure 3:
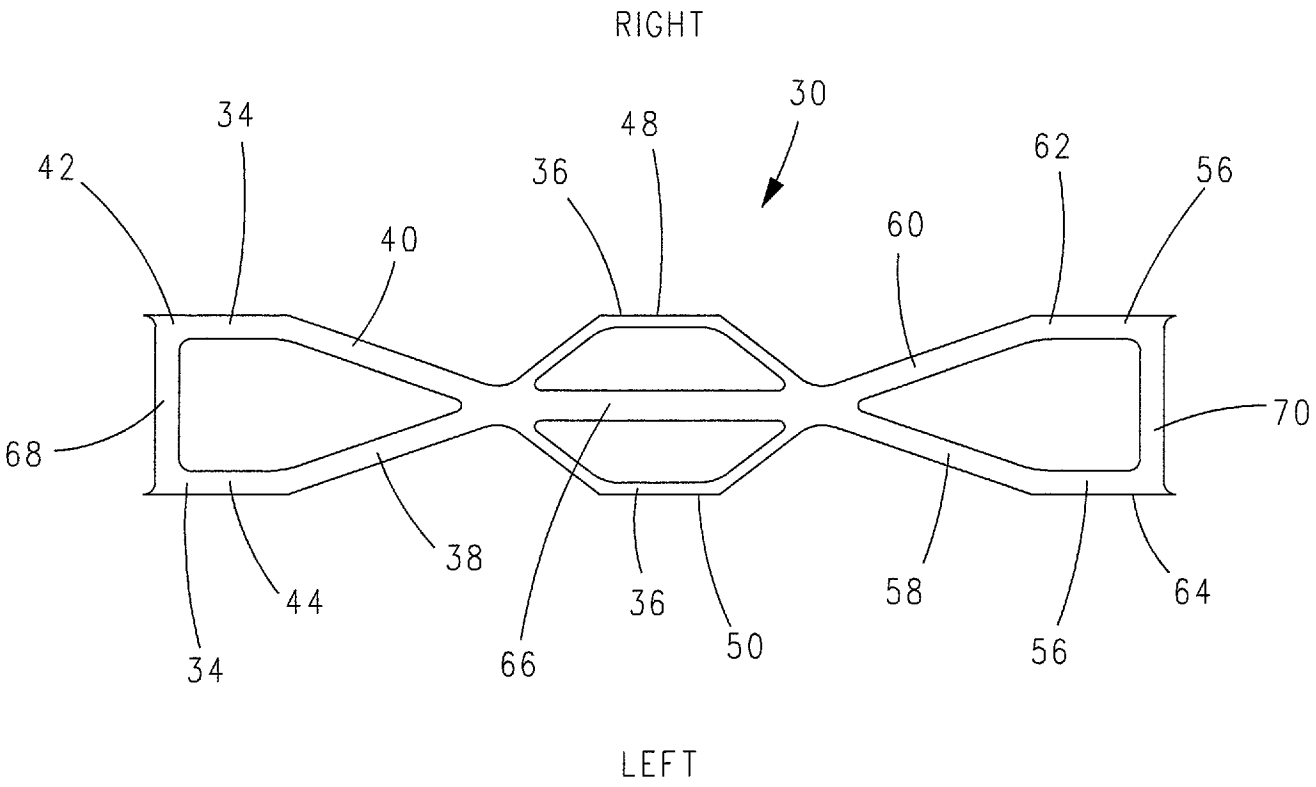
FIG. 3 is a bottom view of a roof lattice structure of FIG. 2 with its outer shell removed.

FIGS. 2 and 3 are now referred to. The roof 22 comprises a lattice structure 30 and an outer shell 32. The lattice structure 30 is made of a pair of first longitudinal segments 34, a pair of second longitudinal segments 36, a first diagonal segment 40 and a second diagonal segment 38. The pair of first longitudinal segments 34 has a right first longitudinal segment 42 and a left first longitudinal segment 44. The right first longitudinal segment 42 is adapted to run along a top portion of the first door opening 26 in the right side wall 20 while the left first longitudinal segment 44 is designed to run along a top portion of the first door opening 26 in the left side wall 18.

Similarly, the pair of second longitudinal segments 36 comprises a right second longitudinal segment 48 and a left second longitudinal segment 50. The right second longitudinal segment 48 runs along a top portion of the second door opening 28 in the right side wall 20 while the left second longitudinal segment 50 runs along a top portion of the second door opening 28 in the left side wall 18.

The first diagonal segment 40 extends from the right first longitudinal segment 42 to the left second longitudinal segment 50 while the second diagonal segment 38 extends from the left first longitudinal segment 44 to the right second longitudinal segment 48. The first and second diagonal segments 40, 38 are not necessarily straight and can be bent or curved depending on the structural requirements of the vehicle and on applied loads. Moreover, the first and second diagonal segments 40, 38 may have a variable section along their length.

The outer shell 32 is placed atop the lattice structure 30 and extends from a region proximate the front end 12 to a region proximate the rear end 14 of the vehicle body 10. The outer shell 32 is typically a single skin of material, either composite or metallic, such as aluminum, but can also be made of a sandwich construction for increased rigidity in between the lattice structure 30. The outer shell 32 may be made integrally with the lattice structure 30, or may be joined to the lattice structure 30 using methods well known to the person skilled in the art such as through bonding, riveting, bolting, welding, etc.

When each one of the left and right side walls 18, 20 are further equipped with a third door opening 54, the lattice structure 30 further comprises a pair of third longitudinal segments 56, a third diagonal segment 58 and a fourth diagonal segment 60.

The pair of third longitudinal segments 56 is made of a right third longitudinal segment 62 and a left third longitudinal segment 64. The right third longitudinal segment runs along a top portion of the third door opening 54 in the right side wall 20 while the left third longitudinal segment 64 is designed to run along a top portion of the third door opening 54 in the left side wall 18. The third diagonal segment 58 extends from the right second longitudinal segment 48 to the left third longitudinal segment 64. Similarly, the fourth diagonal segment 60 extends from the left second longitudinal segment 50 to the right third longitudinal segment 62.

Similarly to the first and second diagonal segments 40, 38 third and fourth diagonal segments 58, 60 are not necessarily straight and can be bent or curved depending on the structural requirements of the vehicle and on applied loads. Moreover, the first and second diagonal segments 58, 60 may have a variable section along their length.

A longitudinal median segment 66 is also part of the lattice structure 30 and extends from an intersection point between the first and the second diagonal segments 40, 38 to an intersection point between the third and the fourth diagonal segments 58, 60.

The lattice structure 30 further comprises a first transversal segment 68 and a second transversal segment 70. The first transversal segment 68 extends between the right first longitudinal segment 42 and the left first longitudinal segment 44 while the second transversal segment 70 extends between the right third longitudinal segment 62 and the left third longitudinal segment 64.

Figure 4:
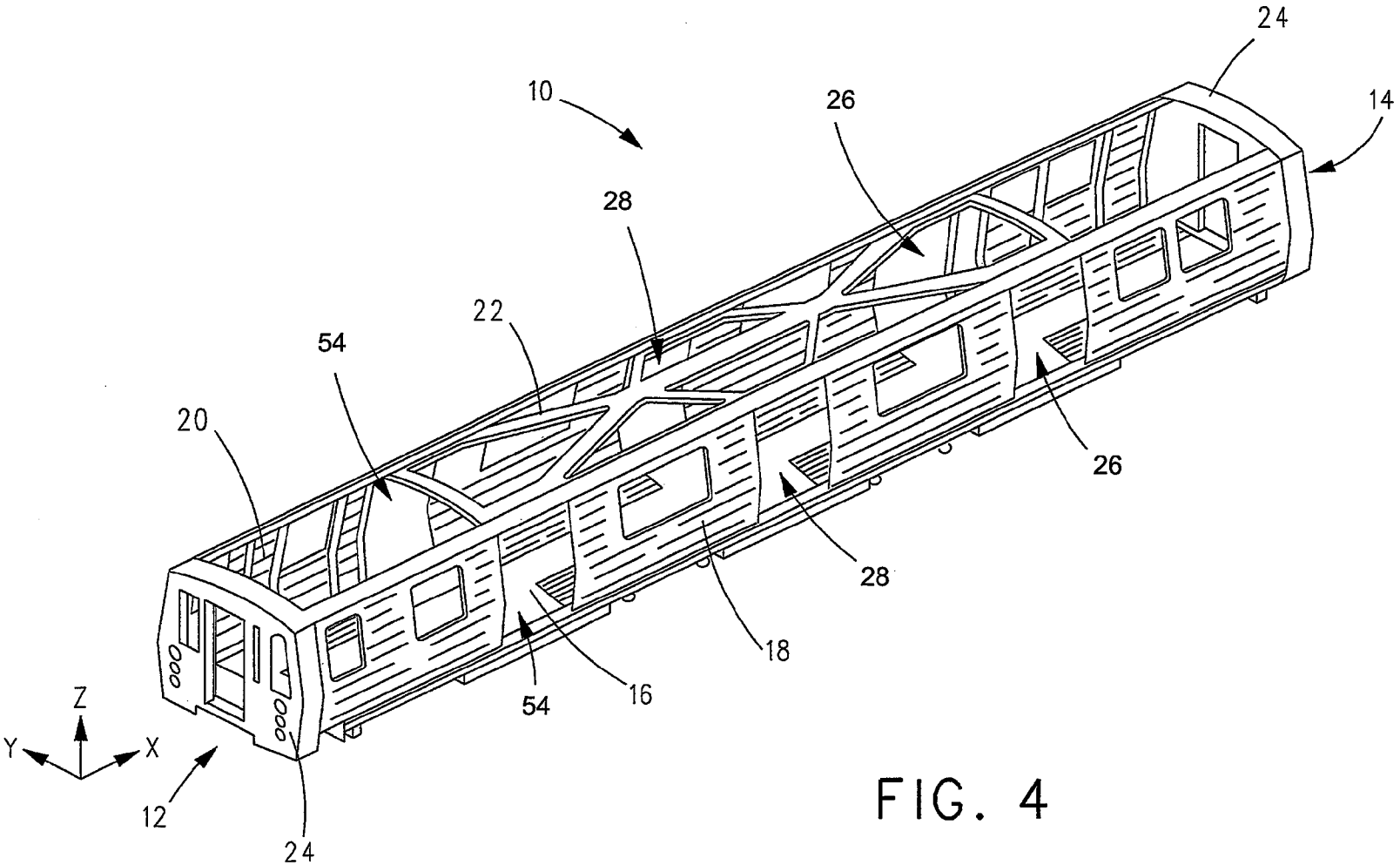
FIG. 4 is a perspective view of the rail vehicle body of FIG. 1 with the roof outer shell removed to expose the roof lattice structure in accordance with an embodiment of the present invention.

FIG. 4 is now referred to. Optionally, the pair of first longitudinal segments 34 extends up to the pair of second longitudinal segments 36 which in turn extend up to the pair of third longitudinal segments 56 so as to form a pair of continuous longitudinal segments. Moreover, both the pair of first longitudinal segments 34 and the pair of third longitudinal segments 56 may extend respectively up to the rear end 14 and to the front end 12 of the vehicle body 10. The lattice structure 30 may be connected either directly to the side walls 18, 20 or through a cant rail 68. In this case, the cant rail 68 may integrally be formed with the lattice structure 30, or be connected in manners well known to the person skilled in the art such as by welding, bonding, riveting, bolting, etc.

The lattice structure 30 may be made of different materials such as steel, aluminum and composite materials. Advantageously, the lattice structure 30 may be made of a hollow structure, such as an aluminum extrusion. If composite materials are used, the lattice structure 30 may be made of a foam core covered by layers of composite materials. The lattice structure 30 is designed to withstand different load cases, especially when the vehicle body 10 is loaded in bending and in torsion. Because the door openings 26, 28 create weaknesses in the side wall structures 18, 20, the lattice structure advantageously contributes to the rigidity of the whole vehicle by reinforcing the side walls 18, 20 in the area of the door openings 26, 28, 54 and transferring the loads laterally and longitudinally in the vehicle body 10.

Figure 5:
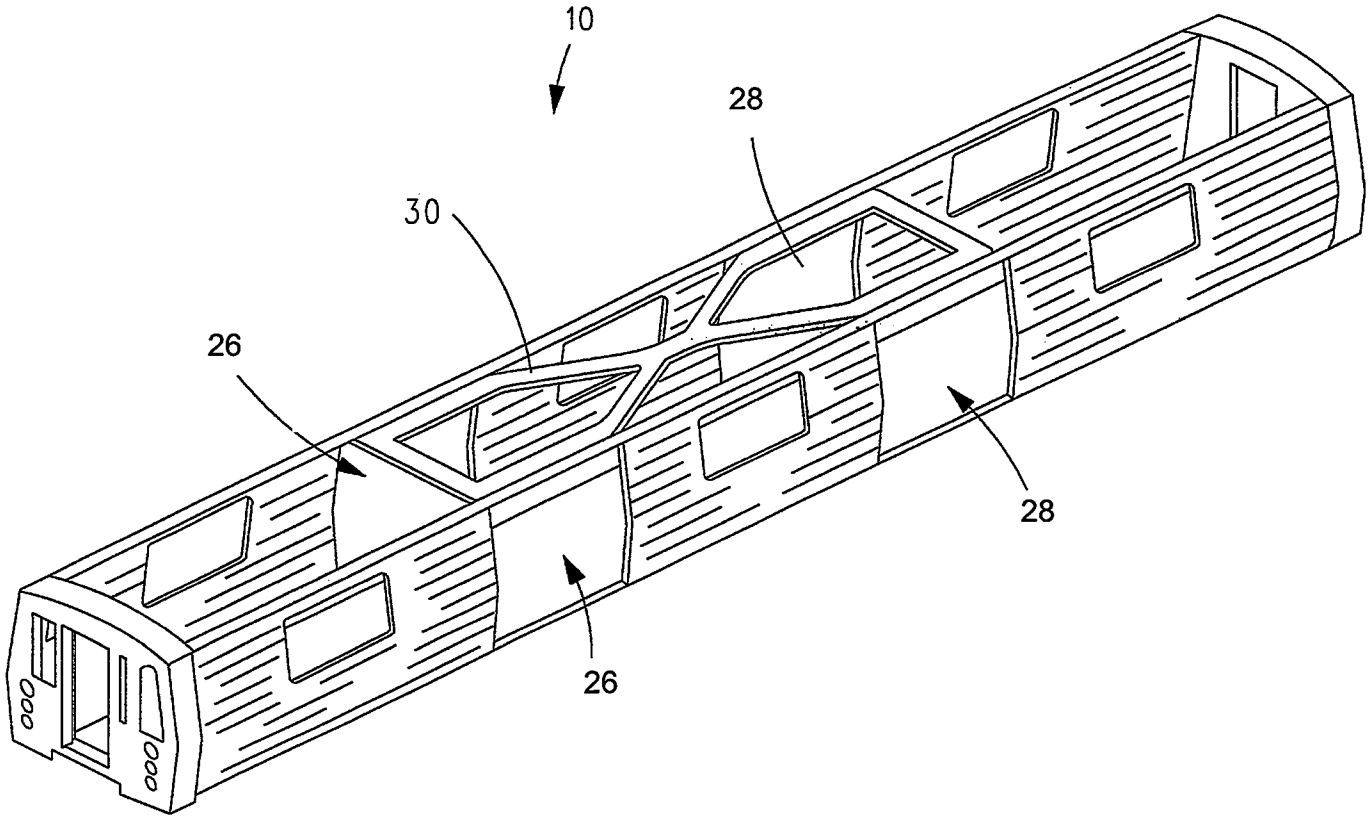
FIG. 5 is a perspective view of a rail vehicle body having four door openings in accordance with another embodiment of the present invention.

When the vehicle body 10 is provided with only four door openings, it is possible that there is no requirement for any longitudinal segment 66. This is shown in FIG. 5.

Figure 6:
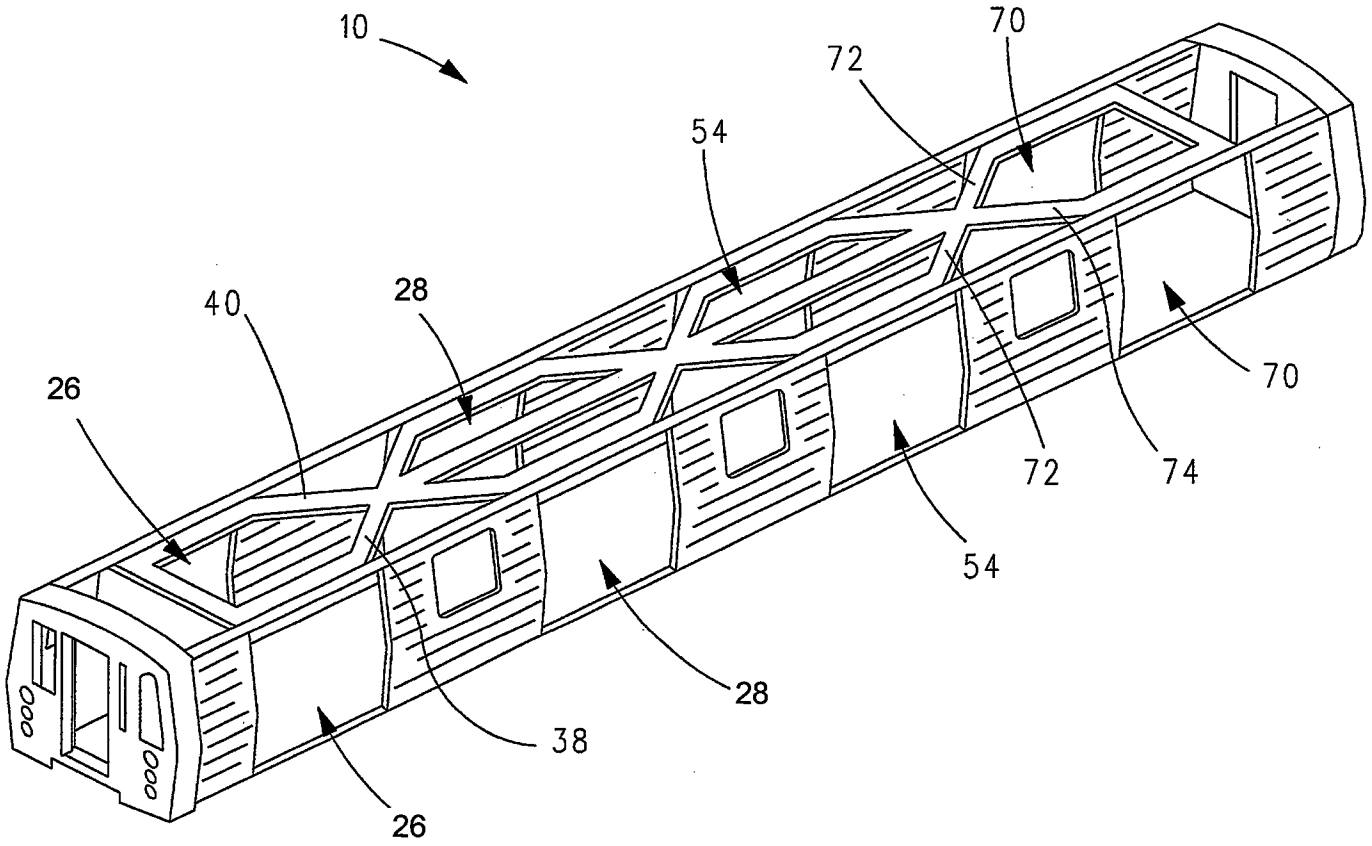
FIG. 6 is a perspective view of a rail vehicle body having eight door openings in accordance with another embodiment of the present invention.

FIG. 6 depicts the rail vehicle body 10 equipped with eight door openings. It may be observed that an additional pair of longitudinal segments is provided at the top of the fourth door openings 70, additional fifth and sixth diagonal segments 72, 74 are provided extending between opposite sides of the fourth door openings 70 and of the third door openings 54. The longitudinal median segment extends from the intersection of the first and second diagonal segments 40, 38 to the intersection of the fifth and sixth diagonal segments 72, 74.

The present invention has been described with reference to the accompanying figures. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A rail vehicle having a front end and a rear end, the vehicle comprising:

a floor;

a left side wall;

a right side wall, each one of said right and left side wall extending from said front end to said rear end, each one of said right and left side walls having sequentially a first wall portion, a first door opening, a second wall portion, a second door opening and a third wall portion; and a roof, said roof having:

a lattice structure, said lattice structure having:

a pair of first longitudinal segments, said pair of first longitudinal segments having a right first longitudinal segment and a left first longitudinal segment, said right first longitudinal segment running along a top edge of said first door opening in the right side wall, said left first longitudinal segment running along a top edge of said first door opening in said left side wall;

a pair of second longitudinal segments, said pair of second longitudinal segments having a right second longitudinal segment and a left second longitudinal segment, said right second longitudinal segment running along a top edge of the second door opening in said right side wall, said left second longitudinal segment running along a top edge of said second door opening in said left side wall;

a first diagonal segment extending from said right first longitudinal segment to said left second longitudinal segment;

a second diagonal segment extending from said left first longitudinal segment to said right second longitudinal segment, said first diagonal segment and said second diagonal segment intersecting in an area longitudinally extending along said second wall portion; and an outer shell, said outer shell being placed atop said lattice structure and extending substantially from the front end to the rear end of the vehicle, wherein the first diagonal segment and the second diagonal segment are integrally formed with the pair of first longitudinal segments and the pair of second longitudinal segments.

2. The rail vehicle of claim 1, further comprising:

a first transversal segment, said first transversal segment extending between said right first longitudinal segment and said left first longitudinal segment; and a second transversal segment, said second transversal segment extending between said right second longitudinal segment and said left second longitudinal segment.

3. The rail vehicle of claim 2, wherein said pair of first longitudinal segments and said pair of second longitudinal segments form a pair of continuous longitudinal segments extending from said front end to said rear end.

4. The rail vehicle of claim 2, wherein said outer shell is made of a sandwich construction.

5. The rail vehicle of claim 4, wherein said lattice structure is made of composite materials.

6. The rail vehicle of claim 1, wherein said lattice structure is devoid of diagonal segments in an area longitudinally extending along said top edge of any of said first or said second door openings.

7. The rail vehicle of claim 1, wherein each one of said left and right side walls sequentially have a third door opening adjacent said third wall portion and a fourth wall portion, the lattice structure further comprising:

a pair of third longitudinal segments, said pair of third longitudinal segments having a right third longitudinal segment and a left third longitudinal segment, said right third longitudinal segment running along a top edge of said third door opening in the right side wall, said left third longitudinal segment running along a top edge of the third door opening in the left side wall;

a third diagonal segment extending from said right second longitudinal segment to said left third longitudinal segment; and a fourth diagonal segment extending from said left second longitudinal segment to said right third longitudinal segment, said first diagonal segment and said second diagonal segment intersecting in an area longitudinally extending along said third wall portion.

8. The rail vehicle of claim 7, further comprising a longitudinal median segment, said longitudinal median segment extending from an intersection point between said first and said second diagonal segments to an intersection point between said third and said fourth diagonal segments.

9. The rail vehicle of claim 8, further comprising:

a first transversal segment, said first transversal segment extending between said right first longitudinal segment and said left first longitudinal segment; and a second transversal segment, said second transversal segment extending between said right third longitudinal segment and said left third longitudinal segment.

10. The rail vehicle of claim 9, wherein said pair of first longitudinal segments, said pair of second longitudinal segments and said pair of third longitudinal segments form a pair of continuous longitudinal segments extending from said front end to said rear end.

11. The rail vehicle of claim 10, wherein said outer shell is made of a sandwich construction.

12. The rail vehicle of claim 11, wherein said lattice structure is made of composite materials.

13. The rail vehicle of claim 7, wherein said lattice structure is devoid of diagonal segments in an area longitudinally extending along said top edge of any of said first, said second or said third door openings.

* * * * *